US007695355B2

(12) United States Patent
Doherty

(10) Patent No.: US 7,695,355 B2
(45) Date of Patent: Apr. 13, 2010

(54) INTEGRATED HOUSING FOR FAN AND ALTERNATE FLOW CHECK VALVE

(75) Inventor: James Doherty, Feeding Hills, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 125 days.

(21) Appl. No.: 11/778,283

(22) Filed: Jul. 16, 2007

(65) Prior Publication Data

US 2009/0023381 A1 Jan. 22, 2009

(51) Int. Cl.
*B64D 13/00* (2006.01)
*F24F 7/06* (2006.01)
*B64D 33/02* (2006.01)

(52) U.S. Cl. ..... 454/76; 454/71; 454/259; 454/338; 62/241; 244/53 B

(58) Field of Classification Search ..... 454/70, 454/71, 74, 75, 76, 338, 259; 62/241; 244/53 B
See application file for complete search history.

(56) References Cited

U.S. PATENT DOCUMENTS 3,854,459 A * 12/1974 Stimeling ..... 165/98
4,094,336 A 6/1978 Urschel
4,673,031 A * 6/1987 Wiemer ..... 165/299
4,865,267 A * 9/1989 Severson ..... 244/53 B
4,997,342 A * 3/1991 Conger, IV ..... 415/214.1
5,031,513 A * 7/1991 Cohen ..... 454/70
5,427,502 A 6/1995 Hudson
5,474,120 A * 12/1995 Severson et al. ..... 165/296
5,938,527 A * 8/1999 Oshima et al. ..... 454/344
6,236,184 B1 5/2001 Baker
6,454,247 B2 9/2002 Ujvari
6,837,785 B2 1/2005 Soderlund
6,907,854 B2 6/2005 Wikner
6,942,183 B2 9/2005 Zywiak
6,963,488 B1 * 11/2005 Chen ..... 361/679.49
7,074,010 B2 7/2006 DeGroff
7,197,870 B2 4/2007 Bannon
2005/0151019 A1 * 7/2005 Stevens ..... 244/135 R
2006/0059941 A1 3/2006 Merritt

FOREIGN PATENT DOCUMENTS

JP 57173519 A * 10/1982
JP 02195137 A * 8/1990
JP 2006097609 A * 4/2006

* cited by examiner

*Primary Examiner*—Steven B McAllister
*Assistant Examiner*—Patrick F. O'Reilly, III
(74) *Attorney, Agent, or Firm*—Carlson, Gaskey & Olds

(57) ABSTRACT

A single housing is utilized to mount both an internal fan, and an external alternate flow passage closed by a check valve. The alternate flow passage is defined between an inner and outer wall of the single housing, while the fan is mounted within the inner wall.

12 Claims, 1 Drawing Sheet

INTEGRATED HOUSING FOR FAN AND ALTERNATE FLOW CHECK VALVE

BACKGROUND OF THE INVENTION

This application relates to a housing for a fan, which has alternate flow passages closed by check valves integrated into the housing.

Aircraft are being provided with more and more sophisticated electronic components. Cooling schemes are necessary for cooling these components.

One known cooling scheme is to move cooling air over a liquid which in turn cools the electronics. The cooling air may be taken from an area outside of the aircraft, and returned to the outside of the aircraft after cooling.

The prior art has typically moved this air by an alternative flow arrangement wherein a fan is provided to pull air from outside of the aircraft, and over the fluid to be cooled, through a first conduit. A second wholly separate and branched conduit is also provided, and has a check valve closure.

When the aircraft is on the ground, the fan must be utilized to move the air. However, when the aircraft is in flight, the movement of the aircraft will drive the air and the fan may be stopped. The air then flows through the check valve. In the prior art, this alternative flow line has been provided by a completely separate conduit with a check valve in its own housing. The result has been somewhat cumbersome and unduly large.

SUMMARY OF THE INVENTION

In one embodiment of this invention, a fan is positioned within a housing for rotation about an axis. Check valves for selectively allowing or blocking alternate flow of air are provided circumferentially around the axis of the fan. In one embodiment the check valves and their flow passages extend around more than 180° of the fan. In one embodiment, the check valve and related passages completely surround the fan other than intermediate struts.

These and other features of the present invention can be best understood from the following specification and drawings, the following of which is a brief description.

DETAILED DESCRIPTION OF AN EMBODIMENT

Figure 1:
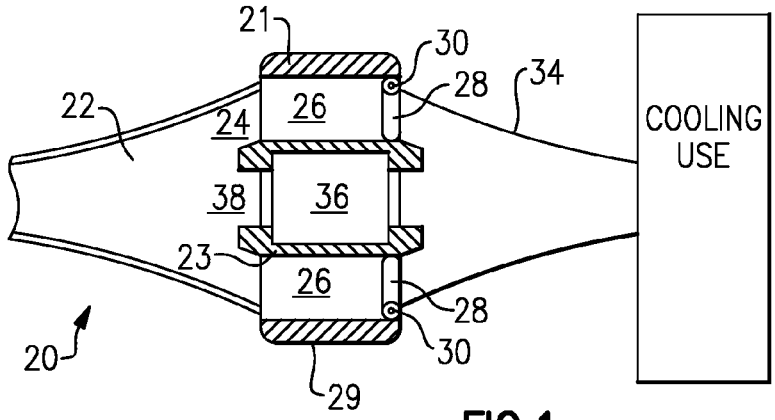
FIG. 1 schematically shows an inventive flow arrangement.

An arrangement 20 is illustrated in FIG. 1 for supplying air to a cooling use. Air is taken from a conduit 22, which may actually communicate with ambient air, such as from the exterior of an aircraft or other vehicle. Air from conduit 22 may be moved into conduit 24, which may be generally annular and surrounds a central conduit 38. The air flowing through the conduit 24 flows into a plurality of flow passages 26 which are selectively closed by check valves 28, for example hingedly attached at 30 to a housing 29. Housing 29 is shown to include a radially inner wall 23, and a radially outer wall 25. While flap check valves 28 are shown, which are hingedly attached to the housing 29, any other type of valve structure would come within the scope of this invention. Other types of pivoting check valves can be utilized, and check valves that move in a direction other than about a pivot point, such as away from a valve seat, can also be used.

A fan 36 selectively drives air from conduit 22 through conduit 38, and into conduit 34 to the cooling use.

Figure 2:
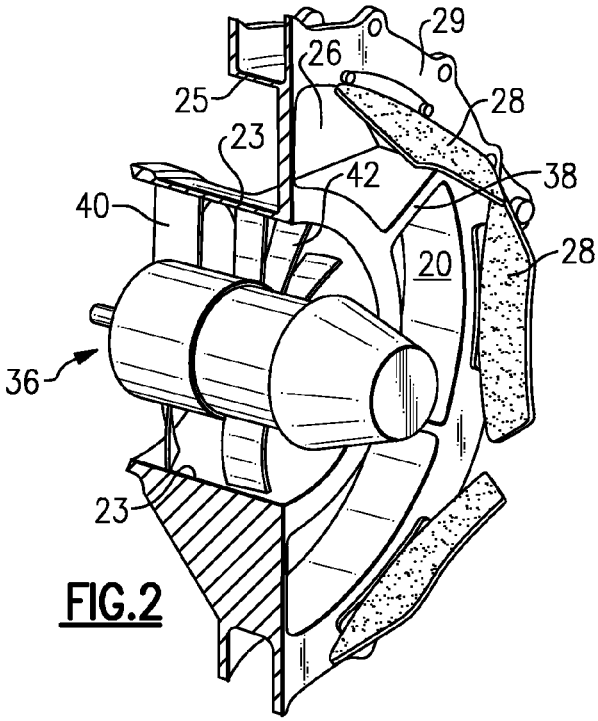
FIG. 2 shows the inventive flow arrangement in one position.
Figure 3:
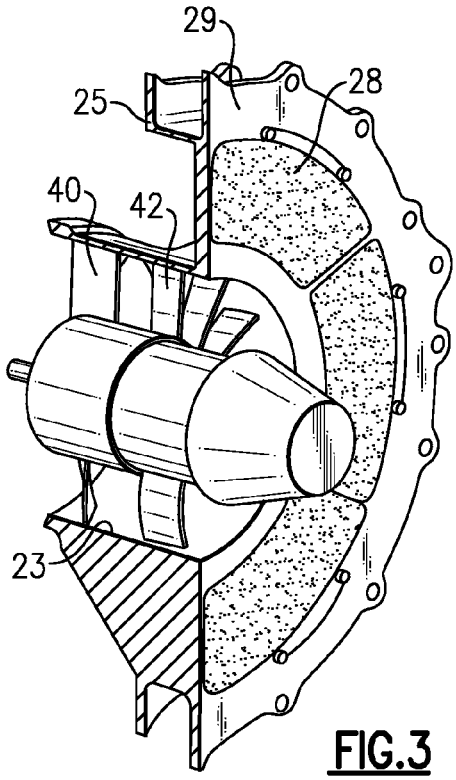
FIG. 3 shows the inventive flow arrangement in an alternate position.

When the aircraft housing the assembly 20 is in the air, air will drive through the passages 26 without the need for the fan 36, holding valves 28 open as shown in FIG. 2. On the other hand, when the aircraft is on the ground, the fan is actuated to pull the air, and the valves 28 will close passages 26 as shown in FIG. 3 without the presence of ram air. As can be appreciated from FIGS. 2-4, the valves 28 pivot about a portion of the housing 29 that is radially outwardly of the radial outer wall 25. The valves thus pivot radially outwardly when pivoting away from the flow passages 26. The valves 28 do not block the central conduit 38 when in their open position as shown in FIG. 2. The check valves are mounted to an outer face of the housing body, such that when pivoting away from the housing body, they move away from the outer face. The check valves block air flow through the alternate flow passages when in a closed position such that air flow generated by the fan does not short circuit through the alternate flow passages.

Figure 4:
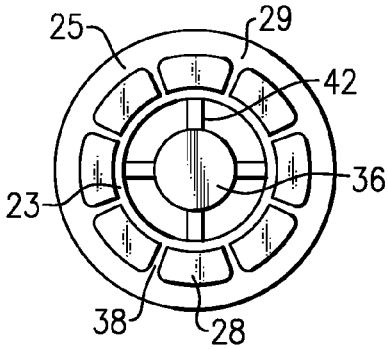
FIG. 4 is a front view of the inventive arrangement.

As shown in FIG. 4, the passages 26 and valves 28 substantially surround the fan 36. In one embodiment, the passages 26 extend for more than 180° about the rotational axis of the fan 36. As shown in FIG. 4, the passages 26 may include all of the circumferential extent about the fan 36, other than the small areas taken by separation struts 38.

As can be appreciated by FIGS. 2 and 3, the fan 36 may be force fit into an interior of the inner wall 23 of the housing 29 with struts or vanes 42 holding the fan 36 within the inner wall 23 of housing 29 by a force fit. The arrangement 20 could use other attachment techniques (e.g. fasteners). The blade 40 rotates within the housing when the fan is driven.

Although not shown, power and control wires extend to a motor for the fan.

Although certain embodiments of this invention have been disclosed, a worker of ordinary skill in this art would recognize that certain modifications would come within the scope of this invention. For that reason, the following claims should be studied to determine the true scope and content of this invention.

What is claimed is:

1. An assembly comprising:

a housing body having an inner wall and a spaced outer wall, a fan mounted within said inner wall and a plurality of alternate flow passages positioned between said inner and outer walls, with at least one check valve closing each of said alternate flow passages; and said check valves being mounted on said housing body radially outwardly of said spaced outer wall, and pivoting away from said housing body in a radial outer direction when moving to an open position, and said check valves being mounted on an outer, radially extending face of said housing body, such that when pivoting away from said housing body, they move away from said outer face;

wherein, whenever the fan is active, said check valves are in a closed position and block air flow through the alternate flow passages such that air flow generated by the fan does not short circuit through the alternate flow passages.

2. The assembly as set forth in claim 1, wherein the flow passages surround a rotational axis of the fan for more than 180°.

3. The assembly as set forth in claim 2, wherein said flow passages are provided with intermediate spaced struts, and with said flow passages including all of the circumferential extent about the rotational axis of the fan other than that taken by the separation struts.

4. The system as set forth in claim 2, wherein said check valves do not block flow through a conduit passing air to said fan in either an open or closed position.

5. The assembly as set forth in claim 1, wherein said fan has fixed structure that is force fit within said inner wall.

6. A system for providing cooling air in an aircraft comprising:

an air supply conduit extending to an outer surface of an aircraft;

a load in the aircraft being cooled;

a housing body fluidly connected to the air supply conduit and having an inner wall and a spaced outer wall, a fan mounted within said inner wall and a plurality of alternate flow passages positioned between said inner and outer walls, with at least one check valve closing each of said alternate flow passages; and said check valves being mounted on said housing body radially outwardly of said spaced outer wall, and pivoting away from said housing body in a radial outer direction when moving to an open position, wherein whenever the fan is active, said check valves are in a closed position and block air flow through the alternate flow passages such that air flow generated by the fan does not short circuit through the alternate flow passages.

7. The system as set forth in claim 6, wherein the flow passages surround a rotational axis of the fan for more than 180°.

8. The system as set forth in claim 7, wherein said flow passages are provided with intermediate spaced struts, and with said flow passages including all of the circumferential extent about the rotational axis of the fan other than that taken by the separation struts.

9. The system as set forth in claim 7, wherein said check valves do not block flow through a conduit passing air to said fan in either an open or closed position.

10. The system as set forth in claim 6, wherein said fan has fixed structure that is force fit within an said inner wall.

11. The system as set forth in claim 6, wherein the load is a cooling fluid or cooling electronics.

12. The system as set forth in claim 6, wherein said check valves being mounted to an outer face of said housing body, such that when pivoting away from said housing body, they move away from said outer face.

* * * * *